US010975673B2

(12) United States Patent
Koli

(10) Patent No.: US 10,975,673 B2
(45) Date of Patent: Apr. 13, 2021

(54) INFLOW CONTROL INCLUDING FLUID SEPARATION FEATURES

(71) Applicant: Jai Kishan Koli, Edmonton (CA)

(72) Inventor: Jai Kishan Koli, Edmonton (CA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 125 days.

(21) Appl. No.: 16/434,788

(22) Filed: Jun. 7, 2019

(65) Prior Publication Data

US 2020/0386086 A1 Dec. 10, 2020

(51) Int. Cl.

| | |
|---|---|
| ***E21B 43/12*** | (2006.01) |
| ***E21B 21/08*** | (2006.01) |
| ***E21B 43/34*** | (2006.01) |
| ***E21B 43/38*** | (2006.01) |
| *E21B 47/06* | (2012.01) |

(52) U.S. Cl.

CPC ..... *E21B 43/121* (2013.01); *E21B 21/08* (2013.01); *E21B 43/34* (2013.01); *E21B 43/38* (2013.01); *E21B 47/06* (2013.01)

(58) Field of Classification Search

CPC ..... E21B 43/121; E21B 21/08; E21B 47/06; E21B 43/36; E21B 43/32; E21B 43/38

See application file for complete search history.

(56) References Cited

U.S. PATENT DOCUMENTS

| | | | | |
|---|---|---|---|---|
| 2,517,198 | A * | 8/1950 | Gilbert | E21B 43/38 166/105.5 |
| 2004/0031608 | A1* | 2/2004 | Hall | E21B 43/38 166/265 |
| 2014/0014357 | A1 | 1/2014 | Riisem | |
| 2015/0021015 | A1* | 1/2015 | Xiao | E21B 34/08 166/250.01 |
| 2015/0337622 | A1* | 11/2015 | Lopez | E21B 43/08 166/66.6 |
| 2016/0369591 | A1 | 12/2016 | Vachon | |

(Continued)

OTHER PUBLICATIONS

International Search Report for International Application No. PCT/US2020/035632, International Filing Date Jun. 2, 2020, dated Sep. 15, 2020, 5 pages.

(Continued)

*Primary Examiner* — Michael R Wills, III

(74) *Attorney, Agent, or Firm* — Cantor Colburn LLP

(57) ABSTRACT

An apparatus for separating fluids and controlling flow of production fluid includes a support structure configured including a fluid conduit and a tubular assembly disposed at the support structure. The tubular assembly includes an outer tube defining a flow path and having an outer tube inlet in fluid communication with the production fluid, and at least one inner tube disposed eccentrically within the outer tube. The support structure and/or the tubular assembly is configured to cause a centrifugal force on the production fluid that at least partially separates the production fluid into a first fluid portion having a higher concentration of high density fluid than an initial concentration, and a second fluid portion having a higher concentration of the low density fluid than the initial concentration of the low density fluid. One or more inner tubes have an inner tube outlet in fluid communication with the fluid conduit.

20 Claims, 6 Drawing Sheets

(56) References Cited

U.S. PATENT DOCUMENTS

| | | | |
|---|---|---|---|
| 2017/0044868 | A1 | 2/2017 | Van Petegem et al. |
| 2018/0179874 | A1 | 6/2018 | Del Pozo et al. |
| 2019/0055823 | A1 | 2/2019 | Koli et al. |

OTHER PUBLICATIONS

Written Opinion for International Application No. PCT/US2020/035632, International Filing Date Jun. 2, 2020, dated Sep. 15, 2020, 4 pages.

* cited by examiner

INFLOW CONTROL INCLUDING FLUID SEPARATION FEATURES

BACKGROUND

Exploration and production of hydrocarbons require a number of diverse activities from various engineering fields to be performed in a borehole penetrating an earth formation. Typically, exploration involves surveying and performing measurements known as logging using a survey or logging tool. Production generally involves activities such as drilling, installing permanent installations, casing perforation, hydraulic fracturing, formation evaluation, well integrity surveys, well stimulation, production logging, pressure pumping and cement evaluation.

There are a variety of tools and components that are deployed downhole to facilitate production. Examples of such components include production screens for filtering solids and particulates from production fluid and inflow control devices. Production fluid typically includes a number of different fluid types, such as water, oil and gas. Typically, production operations involve processing production fluids to remove unwanted materials and water therefrom.

SUMMARY

An embodiment of an apparatus for separating fluids and controlling flow of production fluid includes a support structure configured to be disposed in a borehole in a resource bearing formation, the support structure including a fluid conduit, and a tubular assembly disposed at the support structure. The tubular assembly includes an outer tube defining a flow path and having an outer tube inlet in fluid communication with the production fluid, the production fluid including an initial concentration of a low density fluid and an initial concentration of a high density fluid, and at least one inner tube disposed eccentrically within the outer tube and following the flow path. The support structure and/or the tubular assembly is configured to cause a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid. One or more of the at least one inner tube has an inner tube outlet in fluid communication with the fluid conduit.

An embodiment of a method of separating fluids and controlling flow of production fluid includes disposing a fluid production apparatus in a borehole in a resource bearing formation, the fluid production apparatus including a support structure having a fluid conduit and a tubular assembly disposed at the support structure. The tubular assembly includes an outer tube defining a flow path and having an outer tube inlet in fluid communication with the production fluid, the fluid production apparatus including at least one inner tube disposed eccentrically within the outer tube and following the flow path. The method also includes receiving a production fluid via the outer tube inlet, the production fluid including fluid from the formation, the production fluid including an initial concentration of a low density fluid and an initial concentration of a high density fluid, and flowing the production fluid along the flow path. The flowing causes a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid. The method further includes discharging the second fluid portion from an inner tube outlet into the fluid conduit and receiving the second fluid portion at a surface location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Systems, devices and methods are provided herein for performing aspects of formation fluid production. An embodiment of a production fluid control device or assembly includes a fluid production conduit or tubular assembly that includes a plurality of eccentrically arranged nested tubes configured to receive a production fluid. As described herein, a "production fluid" is a fluid that includes formation fluid produced from a resource bearing formation. Production fluid may include various constituent fluids, such as oil, hydrocarbon gas (e.g., methane and natural gas), non-hydrocarbon gas (e.g., hydrogen sulfide), water and others. The tubular assembly receives production fluid at a fluid intake end of an outer tubular, and flows therethrough. The production fluid is centrifuged and then enters one or more successively smaller tubulars. As production fluid flow through the tubular, the production fluid is separated into fluid portions including a fluid portion with a higher concentration of hydrocarbons.

The nested tubular assembly, in one embodiment, follows an angular or circumferential path about a central axis. Fluid flowing through the tubular assembly experiences a centrifugal force that urges the fluid in a radial direction. Due to the centrifugation, denser fluid such as water migrates radially outwardly, resulting in an at least partial separation of the denser fluid. After a certain distance along the tubular assembly, an inner tubular begins and receives a portion of the fluid having a greater concentration of low density fluid, which includes hydrocarbon fluids. The portion continues to be centrifuged as it flows along the inner tube and is again separated into a higher density portion and a portion having an even greater concentration of hydrocarbon fluids. Higher density fluid is discharged into an annular region, and the smallest tubular in the tubular assembly discharges fluid having a high concentration of hydrocarbons (and a low concentration of unwanted high density fluid such as water) into a production stream that flows toward the surface.

Embodiments described herein provide a number of advantages and technical effects. For example, the flow control assembly, system and methods described herein provide for a relatively simple and cost-effective way to control inflow of production fluid and reject water and other unwanted fluids. Many inflow control designs present challenges such as requiring complex manufacturing, including requiring various machining processes and/or multiple components that increase complexity and risk of failure. Embodiments described herein address such challenges.

Figure 1:
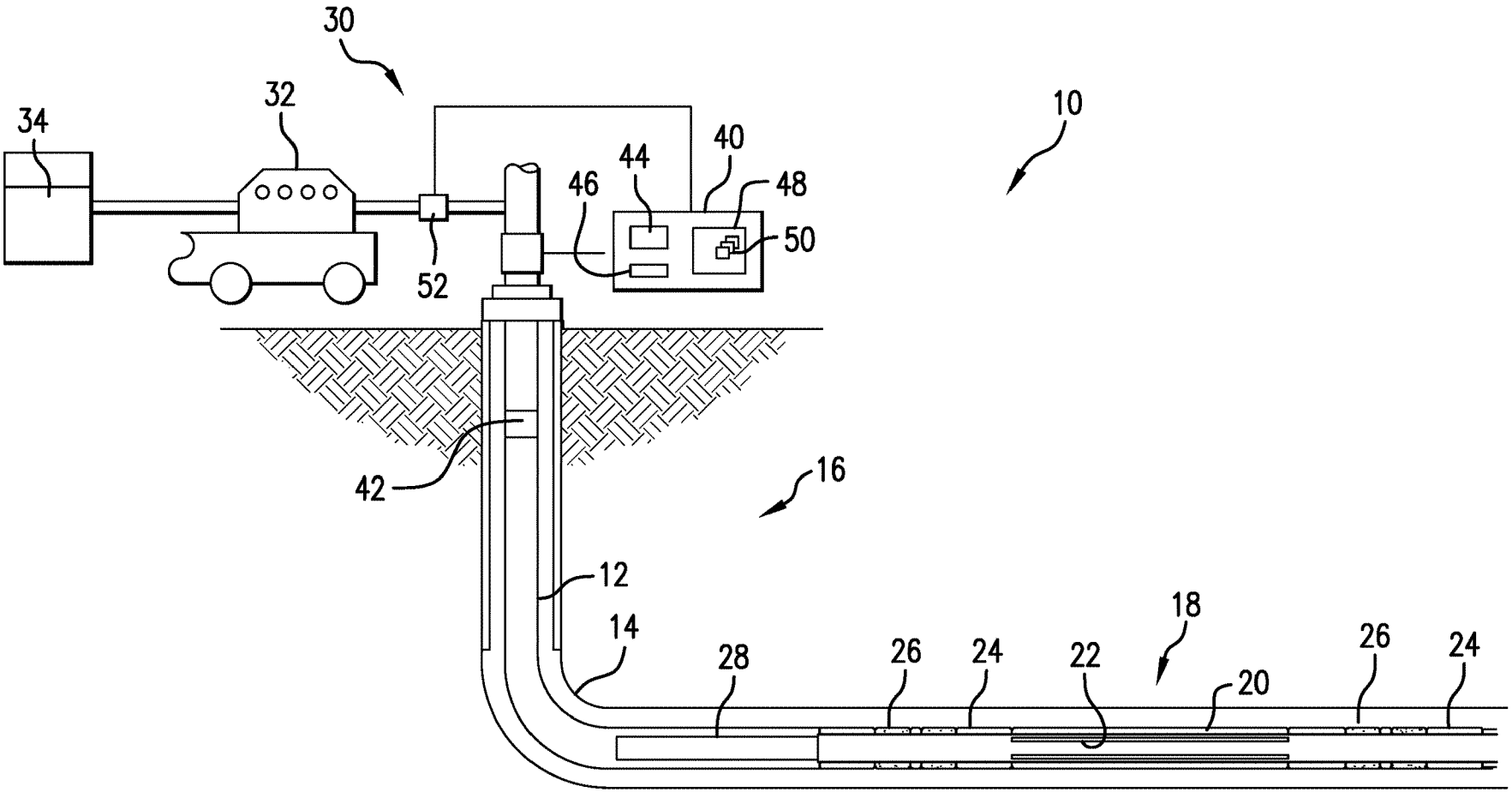
FIG. 1 illustrates an embodiment of a system for performing energy industry operations.

FIG. 1 illustrates an embodiment of a system 10 for performing energy industry operations. The system 10, in the embodiment of FIG. 1, is a completion and hydrocarbon production system 10. The system 10 is not so limited, and may be configured to perform any energy industry operation, such as a drilling, stimulation, measurement and/or production operation, or any other operation related to exploration and/or recovery of resources such as oil and gas.

A borehole string 12 including, e.g., a production string, is configured to be disposed in a borehole 14 that penetrates a resource bearing formation 16 or formation region. The borehole 14 may be an open hole, a cased hole or a partially cased hole. The borehole string 12 may be configured for various uses, such as drilling, completion, stimulation and others, and includes a tubular, such as a coiled tubing, pipe (e.g., multiple pipe segments) or wired pipe, that extends from a wellhead at a surface location (e.g., at a drill site or offshore stimulation vessel). As described herein, a "string" refers to any structure or carrier suitable for lowering a tool or other component through a borehole or connecting a drill bit to the surface, and is not limited to the structure and configuration described herein.

In one embodiment, the borehole string 12 includes a completion and production string configured to be deployed in the borehole 14 to install various components at selected locations to facilitate completion of the borehole 14 or sections thereof. For example, the borehole string 12 includes a completion string having a production assembly 18. The production assembly 18, in one embodiment, includes a screen assembly 20 such as a sand screen assembly or sub, and a production fluid flow control apparatus such as a production fluid flow control assembly 22. The borehole string 12 also includes one or more packer assemblies 24. Each packer assembly includes one or more packer elements 26, which are actuated to isolate components and/or zones in the borehole 12. For example, multiple packer assemblies 24 can be used to establish production zones around the borehole 14. The borehole string 12 and/or the production assembly 18 may include other components to facilitate production, such as an electric submersible pump (ESP) 28, other artificial lift devices, a fracture or "frac" sleeve device and/or a perforation assembly.

The system 10 also includes surface equipment 30 such as a drill rig, rotary table, top drive, blowout preventer and/or others to facilitate deploying the borehole string 12, operating various downhole components, monitoring downhole conditions and controlling fluid circulation through the borehole 14 and the borehole string 12. In one embodiment, the surface equipment 30 includes a fluid control system 32 including one or more pumps in fluid communication with a fluid tank 34 or other fluid source. The fluid control system 32 facilitates injection of fluids, such as drilling fluid (e.g., drilling mud), stimulation fluid (e.g., a hydraulic fracturing fluid), gravel slurries, proppant and others.

In one embodiment, the system 10 includes a processing device such as a surface processing unit 40, and/or a subsurface processing unit 42 disposed in the borehole 14 and connected to one or more downhole components. The processing device may be configured to perform functions such as controlling downhole components, transmitting and receiving data, processing measurement data and/or monitoring operations. In addition, the processing device may control aspects of fluid circulation, such as fluid pressure and/or flow rate in the borehole string 12.

The surface processing unit 40, in one embodiment, includes a processor 44, an input/output device 46 and a data storage device (or a computer-readable medium) 48 for storing data, files, models, data analysis modules and/or computer programs. For example, the storage device 48 stores processing modules 50 for performing functions such as controlling fluid circulation, and downhole components, collecting data, communicating with downhole components, storing data, and/or performing data analysis.

Various sensors and/or measurement tools may be included in the system 10 at surface and/or downhole locations. For example, one or more flow rate and/or pressure sensors 52 may be disposed in fluid communication with the flow control system 32 and the borehole string 12 for measurement of fluid characteristics. The sensors 52 may be positioned at any suitable location, such as proximate to or within a pump, at or near the surface, or at any other location along the borehole string 12 or the borehole 14.

FIGS. 2-5 depict an embodiment of flow control apparatus configured as a production flow control assembly 60 configured to receive production fluid including fluid produced from the formation (referred to as borehole fluid). The production flow control assembly 60 uses centrifugation of received production fluid to at least partially separate low density fluid constituents from high density fluid constituents in the production fluid to facilitate more efficient production of hydrocarbons. The production flow control assembly 60 may be incorporated into the system 10 (e.g., as part of the flow control assembly 22), or in any of a variety of production and/or completion systems.

The flow control assembly 60 separates production fluid constituents such as water and hydrocarbon fluid (e.g., oil and/or gas) by centrifugation. Centrifugation can be accomplished by velocity of the production fluid in a circumferential flow path around a central axis and/or by rotating a support structure on which flow paths are disposed. In one embodiment, the flow control assembly 60 includes a tubular assembly having a plurality of nested tubulars (referred to herein as "tubes") that are configured to advance fluid along a circumferential path, and separate the fluid by centrifugal force caused by the flow of production fluid along the flow path.

In various embodiments, the tubes are described as cylindrical tubes having circular cross-sections and successively smaller diameters. It is noted that the embodiments described herein are not so limited, as the tubes can have any suitable cross-section or shape, such as square, rectangular, ovular, semi-circular and/or any other suitable shape. In addition, the circumferential flow paths are described in some embodiments as being circular, but can have any shape or configuration that causes a centrifugal force as fluid flows.

Figure 2:
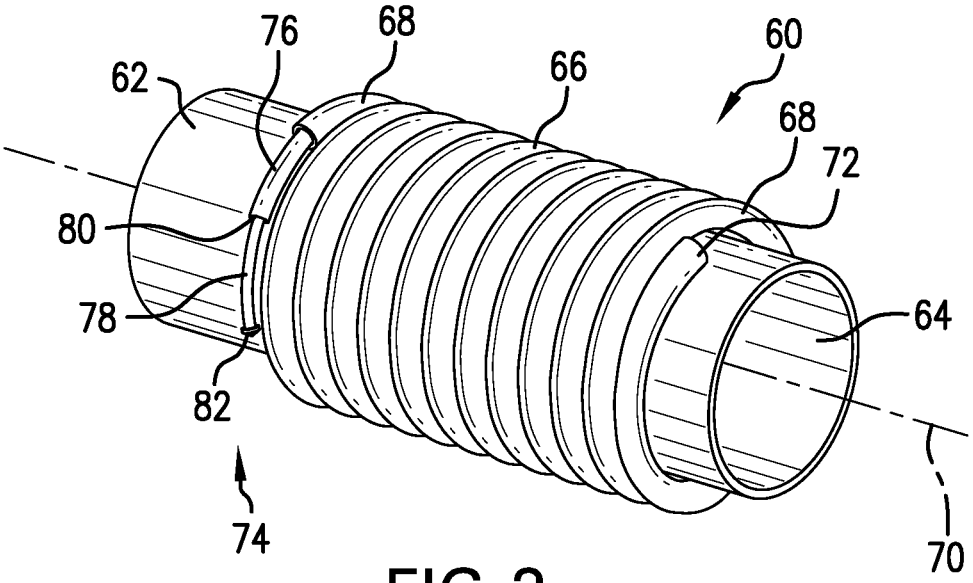
FIG. 2 depicts an embodiment of a production fluid flow control assembly having a plurality of nested tubulars.

Referring to FIG. 2, the flow control assembly 60 includes a support structure such as a cylindrical support body 62. The support body 62 may be disposed with the borehole string 12 in any suitable manner. For example, the support body 62 can be the body of a downhole component such as a pipe joint, a section of drill string, a length of coiled tubing, the body of a flow control sub or component and others. In another example, the support body 62 can be disposed within a production conduit of the borehole string, such as a central production conduit or a cavity or conduit formed within a component.

The support body 62 forms a fluid conduit 64 that may be part of the borehole string production conduit or otherwise is in fluid communication with the production conduit, so that centrifuged fluid can be discharged into a production fluid stream to the surface.

The flow control assembly 60 includes a tubular assembly 66 having a plurality of nested tubulars. For example, the tubular assembly 66 includes an outer tube 68 forming a helical flow path around the support body 62 and a central axis 70 of the support body 62. The outer tube 68 has an outer tube inlet 72 in fluid communication with a source of production fluid. For example, the inlet 72 is in fluid communication with a screen assembly (e.g., the screen assembly 20), an inflow control device, or an annular region 74 of the borehole 14.

The tubular assembly may have any number of inner tubes disposed within the outer tube 68 and following the flow path of the outer tube 68. Each inner tube is eccentrically located with respect to the outer tube. A tube that is eccentrically located within an outer tube refers to a tube that has a central longitudinal axis that is offset from a central longitudinal axis of the outer tube. As discussed further below, the eccentric positioning of the tubes facilitates separation of constituent fluids of the production fluid and removal of unwanted fluids (e.g., water) from the production stream (i.e., a flow of fluid that is received at the surface).

Figure 3:
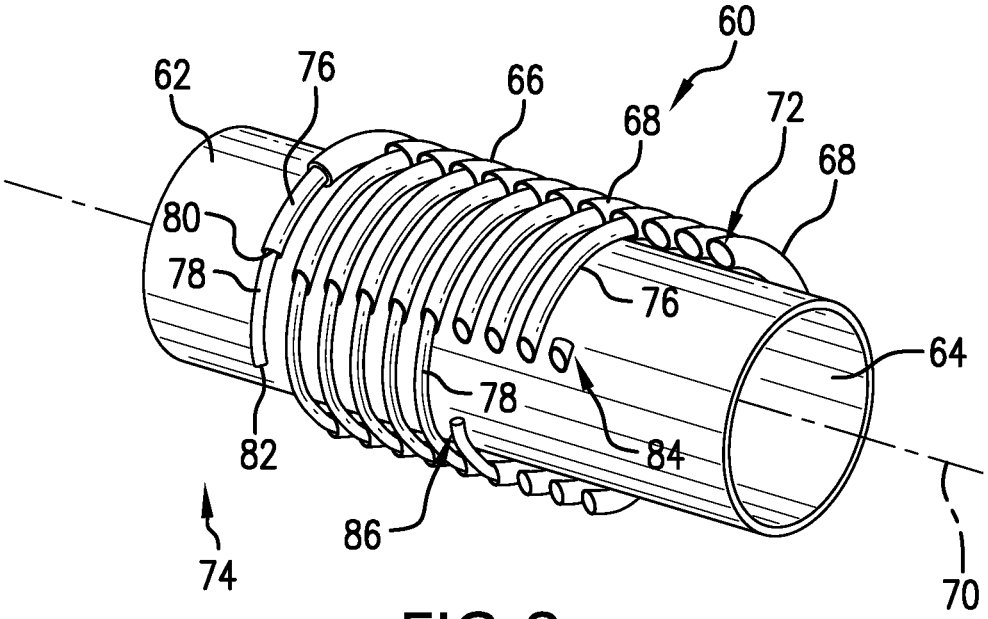
FIG. 3 is a partially dissected view of the flow control assembly of FIG. 2.

In the embodiment of FIG. 2, the eccentrically located tubulars include a plurality of inner tubulars that have progressively smaller sizes or diameters. For example, the tubular assembly 66 includes a first inner tube 76 (also referred to as an intermediate tube) disposed within the outer tube 68 and eccentrically positioned within the outer tube 68. A second inner tube 78 is disposed within the first inner tube 76 and eccentrically positioned within the first inner tube 76. As shown in FIGS. 2 and 3, the first inner tube 76 has an outlet 80 that terminates at a location along the flow path so that the outlet 80 is in fluid communication with the annular region. Likewise, the second inner tube 78 has an outlet 82 that terminates at a location along the flow path so that the outlet 82 is in fluid communication with the annular region. The outlets 80 and 82 may be disposed at the same location or different locations. For example, the outlet 80 is disposed at a location at a first distance from the outer tube inlet 72, and the outlet 82 is disposed at a location at a second distance from the outer tube inlet 72 that is greater than the first distance.

In one embodiment, the second inner tube 78 is an innermost tube configured to discharge separated or centrifuged fluid into the fluid conduit 64 or to any other suitable location of conduit that allows the discharged fluid to be produced to the surface. It is noted that the tubular assembly 66 may have any number of inner tubes, where the innermost tube has an outlet that discharges separated fluid so the separated fluid can be received at a surface location.

Production fluid entering the tubular assembly 66 includes a variety of constituent fluids that may have different densities. For example, production fluid typically includes hydrocarbon fluids such as oils and gas (e.g. natural gas or methane) and other fluid such as non-hydrocarbon gases and water. The tubular assembly separates high density fluids such as water from low density fluids such as oil and gas. The terms "high density" and "low density" are intended to denote relative densities and are not intended to denote specific density values.

As production fluid flows through the tubes of the tubular assembly 66, water and other denser (high density) fluid migrates in a radial direction and accumulates at the periphery of a given tube. Oil, gas and other less dense (low density) fluid remains at a radially inward part of the tube. As described herein, a "radial" direction refers to a direction having a directional component that is normal or perpendicular to the central axis 70. If the support body 62 rotates, the central axis 70 may be a rotational axis. It is noted that the axis 70 may be any axis about which a body rotates and/or axis around which a circumferential flow path follows.

Each successively smaller tube has an inlet that begins within an immediately surrounding tube. In one embodiment, the first inner tube 76 (i.e., the largest inner tube) has an inlet 84 at a first location along the length of the outer tube 68 at a first distance from the outer tube inlet 72. A second inner tube 78 (i.e., the inner tube immediately surrounded by the first inner tube 76) has an inlet 86 at a second location along the length of the outer tube 68 at a second distance from the outer tube inlet 72. Similarly, each successively smaller tube has an inlet at successively longer distances from the outer tube inlet. The locations of the inlets and the distances may be selected based on considerations such as rotational rate, flow rate, tube diameters, relative fluid densities and others.

For example, as shown in FIG. 3, the tubular assembly 66 follows a helical circumferential path around the support body 62 that begins at the outer tube inlet 72. The first inner tube 76 begins at a selected location along the helical path at the inlet 84, and the second inner tube 78 beings at a further location along the helical path at the inlet 86.

Figure 4:
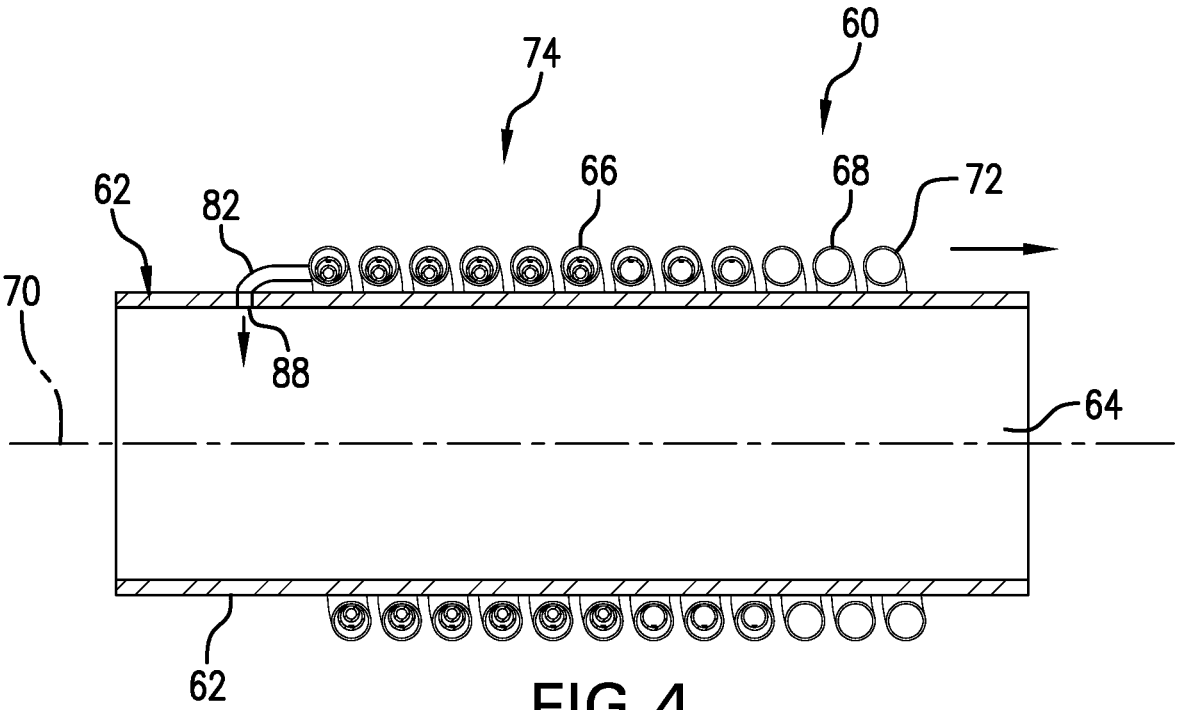
FIG. 4 is a cross-sectional view of the flow control assembly of FIGS. 2 and 3.

Referring to FIG. 4, in one embodiment, the outlet of the innermost tube in the tubular assembly 66 is in fluid communication with the fluid conduit 64. For example, the inner tube outlet 82 is connected to a hole or fluid port 88 through a wall of the support body 62.

It is noted that the tubular assembly 66 may include multiple nested tubular configurations having an outer tube inlet and an innermost tube outlet at multiple positions or locations along the borehole 14 and/or the borehole string. For example, a plurality of tubular assemblies 66 may be arrayed along the borehole string and production conduit.

Figure 5:
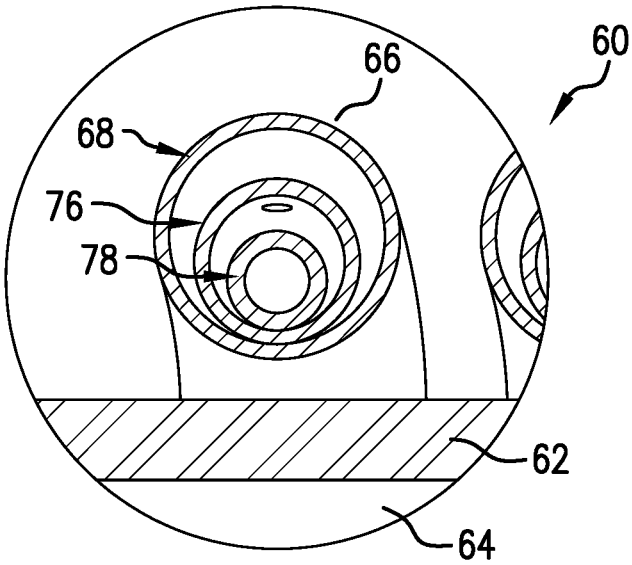
FIG. 5 depicts aspects of an embodiment of a production fluid flow control assembly having a plurality of nested and eccentrically positioned tubulars.

Referring to FIG. 5, in one embodiment, the tubes making up the tubular assembly 66 are eccentrically positioned, so that each successive tube has a cross-sectional area that is radially closer to the central axis 70 (or other radially inward location). In one embodiment, each tube is eccentrically and tangentially connected so that it is in contact with or proximate to a radially inward surface of the immediately surrounding tube. FIG. 5 shows an example of the eccentric and tangential position of the outer tube 68, the first inner tube 76 and the second inner tube 78. The tubes may be tack welded or otherwise connected to one another to maintain this eccentric configuration along the length and flow path of the tubular assembly 66.

As production fluid flows through progressively smaller tubes (i.e., tubes having progressively smaller diameters), the production fluid is centrifuged and denser fluid migrates radially outwardly, resulting in denser fluid migrating outwardly. The tubes are eccentrically positioned, so that as centrifuged fluid enters a smaller tube from a larger tube, the centrifuged fluid is separated into a first fluid portion having a higher concentration of high density fluid (e.g., water) than the initial production fluid, and a second fluid portion having a higher concentration of the low density fluid (e.g., oil). The fluid portions are separated such that the first fluid portion remains in the larger tube (and is subsequently discharged into an annular region) and the second portion enters the smaller tube. This process is repeated for each additional tube, further separating the fluid and increasing the high density fluid concentration until discharge from the smallest tube into the production flow to the surface.

As noted above, the tubular assembly 66 may be configured to rotate to apply centrifugal force to the production fluid as the production fluid flows through the tubular assembly 66. For example, the support body 62 can be rotated as production fluid flows from the formation 16 into the borehole string 12. The support body can be rotated in any suitable manner, such as mechanically (e.g., by a mechanical actuator), electrically (e.g., via a solenoid), hydraulically or in any other desired manner.

Figure 6:
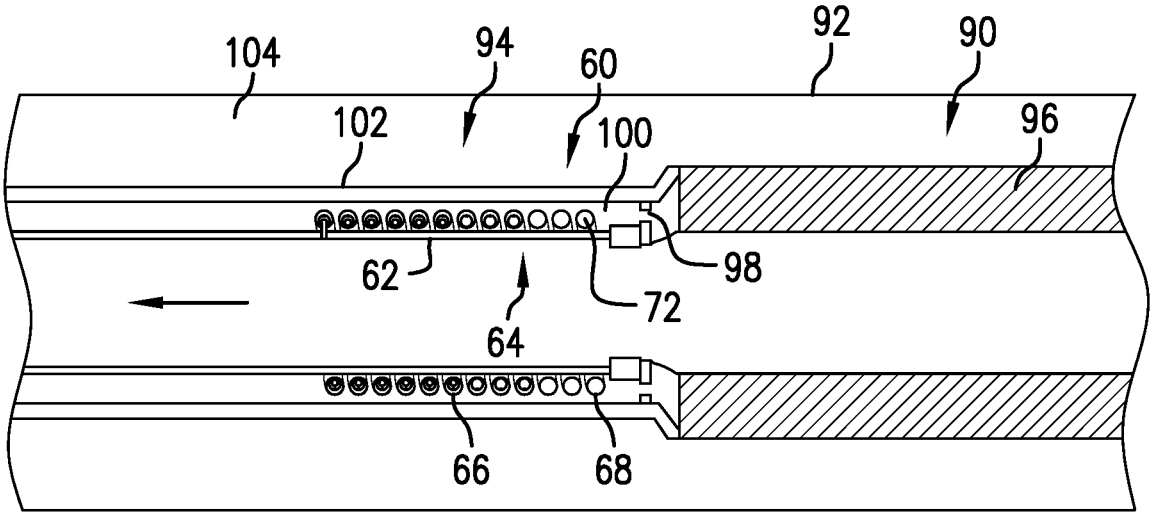
FIG. 6 depicts aspects of an embodiment of a production assembly having a screen assembly and an inflow control device.

FIG. 6 illustrates an example of a production assembly or system that incorporates a flow control assembly having a rotating configuration. In this example, the production assembly includes a screen assembly 90 disposed in a borehole 92 and in fluid communication with fluid entering the borehole from a formation. The production assembly 90 includes an inflow control assembly such as an inflow control device (IDC) 94 that incorporates the flow control assembly 60. The production assembly depicted is for illustration purposes and is not intended to be limiting. In addition, the flow control assembly may have any desired or suitable configuration that includes nested tubulars configured to separate production fluid via centrifugation.

In this example, the screen assembly 90 includes a screen 96 through which production fluid enters a production string. Production fluid is filtered through the screen to remove solids and particulates, and proceeds to the IDC 94 through a passage 98 and enters a flow region 100 between a body 102 of the IDC 94 and the support body 62. Although only one tubular assembly 66 is shown in FIG. 6, the IDC 94 is not so limited and may have any number of tubular assemblies 66 arrayed along the IDC 94 (or multiple IDCs).

Production fluid enters the tubular assembly 66, is centrifuged and separated as discussed above, and high density fluid such as water is discharged into an annular region 104 of the borehole 92. Fluid having a high concentration of low density fluid (e.g., oil) is discharged into the fluid conduit 64 and flows to the surface.

In one embodiment, the support body 62 and the tubular assembly 66 is rotated along an axis of the production string during production. For example, the ICD 94 and/or the support body 66 is operably connected to a downhole rotation device, such as an ESP or positive displacement configuration.

Figure 7:
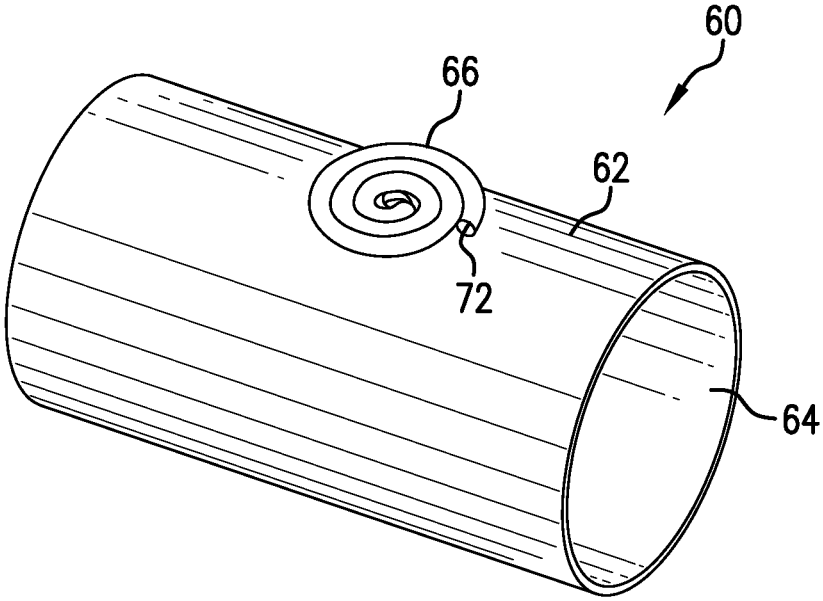
FIG. 7 depicts an embodiment of a production fluid flow control assembly having a plurality of nested tubulars.
Figure 8:
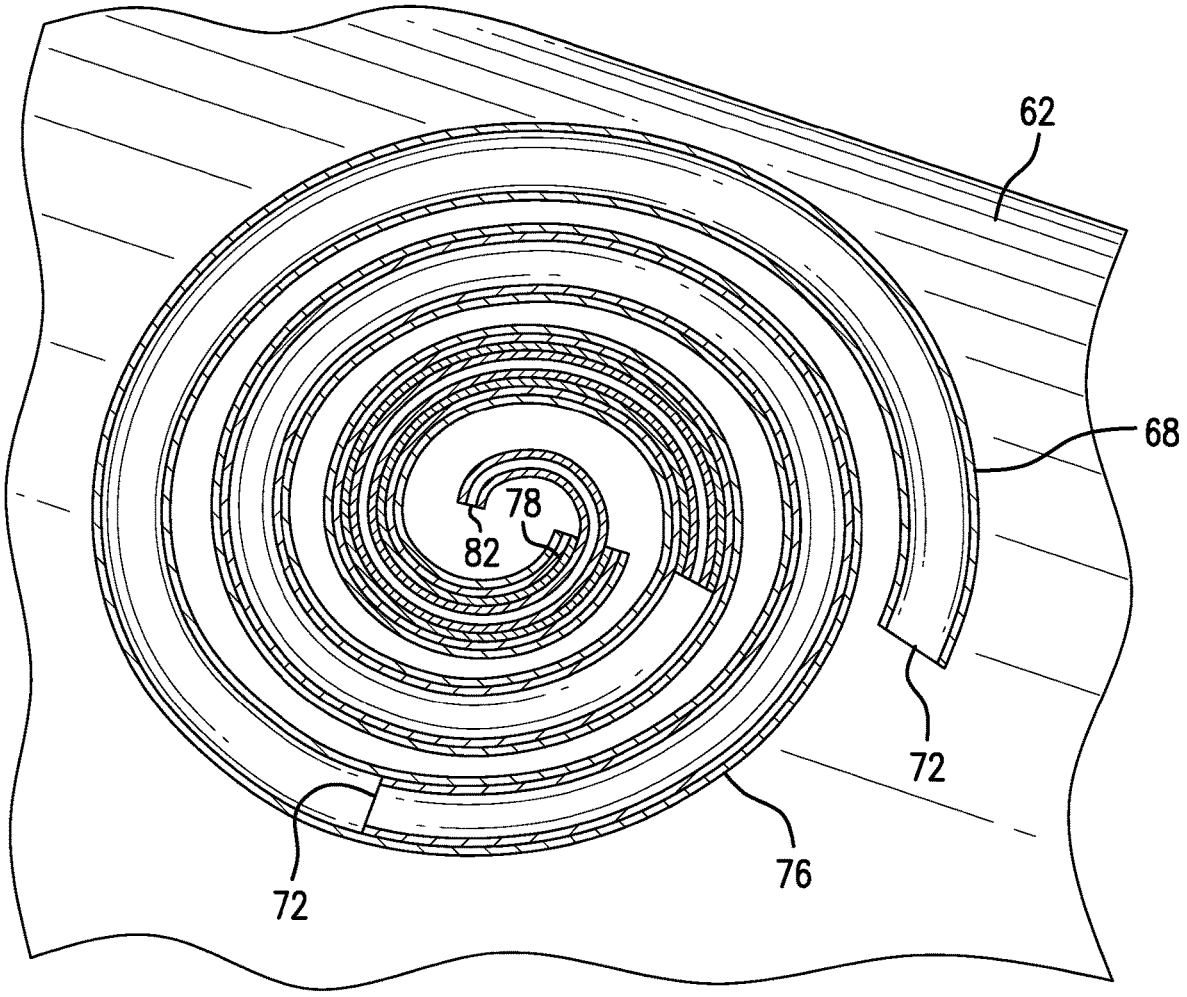
FIG. 8 depicts a cross sectional tubular assembly of the flow control assembly of FIG. 7.

FIGS. 7-8 show an embodiment of the flow control assembly 60 having a tubular assembly 66 with another configuration. In this embodiment, the tubular assembly 66 includes a plurality of nested tubes that follow a spiral flow path at or near the outer surface of the support body 62. The support body 62 may rotate during production by any suitable mechanism as discussed above.

Figure 9:
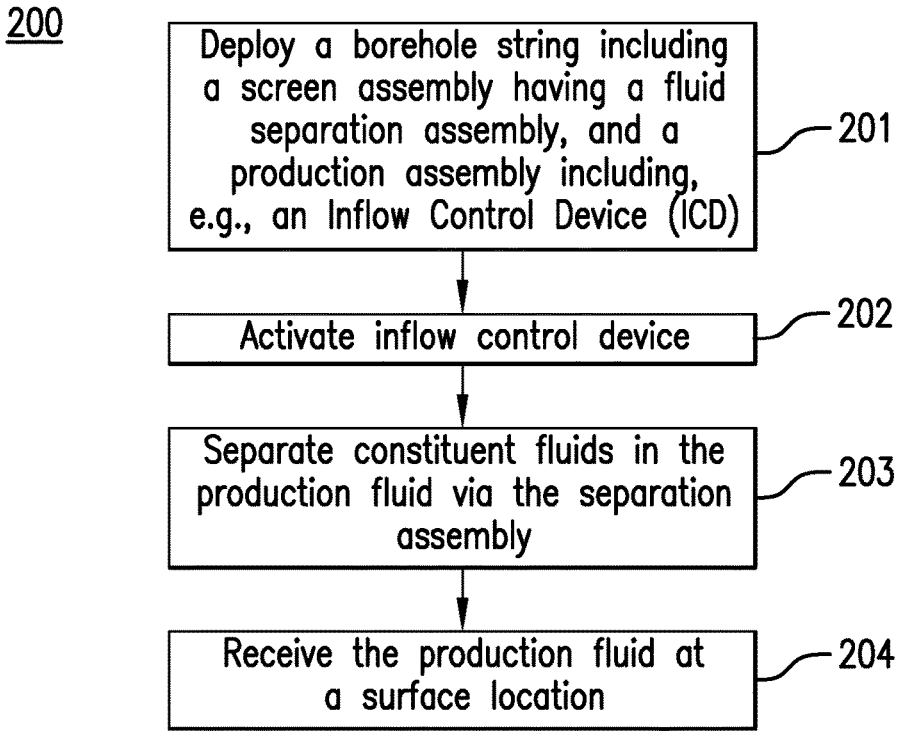
FIG. 9 is a flow chart depicting an embodiment of a method of producing fluid from a formation.

FIG. 9 is a flow chart that illustrates an embodiment of a method 200 producing fluid from a borehole. Aspects of the method 200 or functions or operations performed in conjunction with the method (e.g., controlling fluid injection and/or production fluid flow rates) may be performed by one or more processing devices, such as the surface processing unit 40, either alone or in conjunction with a human operator.

Figure 10:
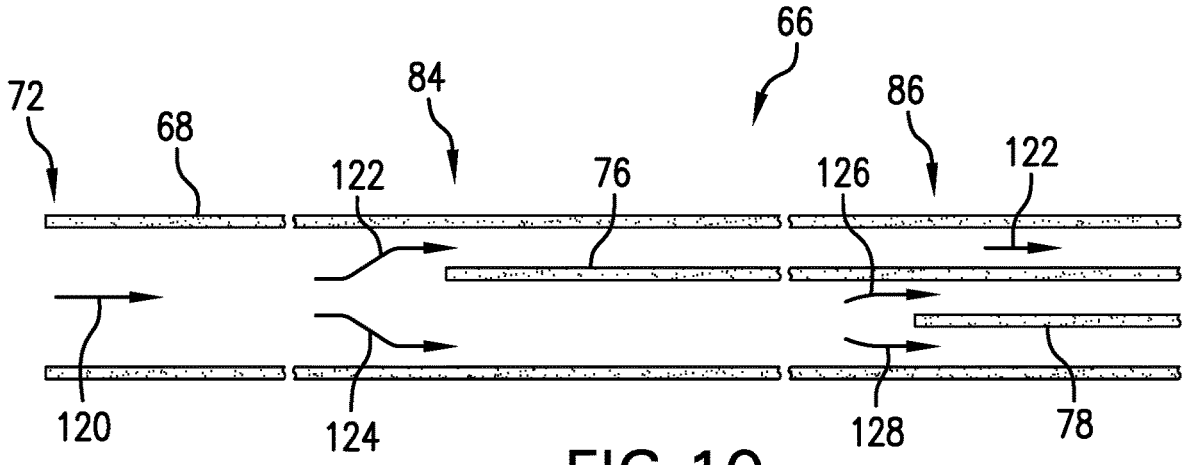
FIG. 10 depicts an example of production fluid flow and separation during the method of FIG. 9.

The method 200 is discussed in conjunction with the system 10 of FIG. 1, and with the flow control device of FIG. 2, but is not so limited. In addition, the method 200 is discussed in conjunction with a simplified illustration in FIG. 10 of portions of the tubular assembly 66 for illustration purposes. The illustration of FIG. 10 is not intended to describe any particular length, size or configuration of tubes.

The method 200 includes one or more stages 201-204. In one embodiment, the method 200 includes the execution of all of the stages 201-204 in the order described. However, certain stages may be omitted, stages may be added, or the order of the stages changed.

In the first stage 201, an energy industry operation, such as a production operation, is performed. For example, the borehole string 12 is deployed into the borehole 14 and advanced to a selected depth or location along the borehole 14. Various operations may be performed prior to commencing production, such a completion and/or stimulation operations (e.g., perforation and/or hydraulic fracturing).

In the second stage 202, an inflow control device or other suitable component is activated to commence production of fluid (referred to as production fluid) from the formation 16 and the borehole 14. For example, a sliding sleeve is activated by dropping a deployable object (ball, dart), transmitting an activation signal, increasing pressure or employing any other mechanism to commence production of fluid into the borehole string 12.

In the third stage 203, production fluid is advanced to an ICD or other device having the flow control assembly 60. As shown in FIG. 10, production fluid 120 enters the outer tube inlet 72. As the production fluid 120 flows through the outer tube 68 and/or the support body 62 is rotated, water (and/or other high density fluid) migrates radially outwardly. Hydrocarbon fluid such as oil (and/or other low density fluid) remains at a radially inward location.

When the centrifuged fluid 120 reaches the first inner tube inlet 84, the fluid is separated into a first high density portion 122 having a high water concentration, and a low density portion 124 having a high oil concentration. The first high density portion 122 continues to flow through the outer tube 72 until it is eventually discharged into an annular region.

The low density portion 124 continues along the first inner tube 76 and is further centrifuged. The further centrifuged low density portion 124 is again separated at the second inner tube inlet 86 into high density fluid 126 and low density fluid 128 that has a higher oil concentration. The low density fluid 128 is discharged into a production stream, or advanced to additional successively smaller tubes until it is finally discharged.

At block 204, low density fluid, which is now mostly oil (or at least has a higher oil concentration than the production fluid that entered the tubular assembly 66) flows to the surface. Artificial lift mechanisms such as an ESP may be used to facilitate flow to the surface.

Set forth below are some embodiments of the foregoing disclosure:

Embodiment 1: An apparatus for separating fluids and controlling flow of production fluid, comprising: a support structure configured to be disposed in a borehole in a resource bearing formation, the support structure including a fluid conduit; and a tubular assembly disposed at the support structure, the tubular assembly including: an outer tube defining a flow path and having an outer tube inlet in fluid communication with the production fluid, the production fluid including an initial concentration of a low density fluid and an initial concentration of a high density fluid; and at least one inner tube disposed eccentrically within the outer tube and following the flow path; wherein at least one of the support structure and the tubular assembly is configured to cause a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid, one or more of the at least one inner tube having an inner tube outlet in fluid communication with the fluid conduit.

Embodiment 2: The apparatus of any prior embodiment, wherein the low density fluid is a hydrocarbon fluid and the high density fluid is water.

Embodiment 3: The apparatus of any prior embodiment, wherein the outer tube has an outer tube, and the inner tube is configured to discharge the second fluid portion into a production conduit connected to a surface location.

Embodiment 4: The apparatus of any prior embodiment, wherein the flow path is a circumferential path around a central axis, the central axis at least partially parallel to a longitudinal axis of at least one of the borehole and a borehole string, and flow of the production fluid along the fluid path causes at least part of the centrifugal force.

Embodiment 5: The apparatus of any prior embodiment, wherein the outer tube defines an outer tube axis, the at least one inner tube defines an inner tube axis, the inner tube axis offset from the outer tube axis in a radial direction toward the central axis.

Embodiment 6: The apparatus of any prior embodiment, wherein the support structure has an elongated shape corresponding to the circumferential path and is configured to rotate about the longitudinal axis to contribute to the centrifugal force.

Embodiment 7: The apparatus of any prior embodiment, wherein the tubular assembly is wrapped around the support structure and follows a helical path.

Embodiment 8: The apparatus of any prior embodiment, wherein the support structure is configured to rotate about a rotational axis, rotation of the support structure contributing to the centrifugal force.

Embodiment 9: The apparatus of any prior embodiment, wherein the tubular assembly follows a spiral path at a surface of the support structure.

Embodiment 10: The apparatus of any prior embodiment, wherein the at least one inner tube includes a plurality of inner tubes having progressively smaller sizes and having respective inlets at successively greater distances from the outer tube inlet, the plurality of inner tubes including an intermediate inner tube having an intermediate inlet at a first distance from the outer tube inlet, and an innermost tube having an innermost inlet at a second distance from the outer tube inlet, the second distance being greater than the first distance, the intermediate tube configured to discharge fluid including the high density fluid into an annular region of the borehole and the innermost tube configured to discharge fluid including the low density fluid into the fluid conduit.

Embodiment 11: A method of separating fluids and controlling flow of production fluid, comprising: disposing a fluid production apparatus in a borehole in a resource bearing formation, the fluid production apparatus including a support structure having a fluid conduit and a tubular assembly disposed at the support structure, the tubular assembly including an outer tube defining a flow path and having an outer tube inlet in fluid communication with the production fluid, the fluid production apparatus including at least one inner tube disposed eccentrically within the outer tube and following the flow path; receiving a production fluid via the outer tube inlet, the production fluid including fluid from the formation, the production fluid including an initial concentration of a low density fluid and an initial concentration of a high density fluid; flowing the production fluid along the flow path, wherein flowing causes a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid; and discharging the second fluid portion from an inner tube outlet into the fluid conduit and receiving the second fluid portion at a surface location.

Embodiment 12: The method of any prior embodiment, wherein the low density fluid is a hydrocarbon fluid and the high density fluid is water.

Embodiment 13: The method of any prior embodiment, further comprising discharging the second fluid portion into an annular region of the borehole.

Embodiment 14: The method of any prior embodiment, wherein the flow path is a circumferential path around a central axis, the central axis at least partially parallel to a longitudinal axis of at least one of the borehole and a borehole string, and flow of the production fluid along the flow path causes at least part of the centrifugal force.

Embodiment 15: The method of any prior embodiment, wherein the outer tube defines an outer tube axis, the at least one inner tube defines an inner tube axis, the inner tube axis offset from the outer tube axis in a radial direction toward the central axis.

Embodiment 16: The method of any prior embodiment, wherein the support structure has an elongated shape corresponding to the circumferential path, and flowing the production fluid includes rotating the support structure about the longitudinal axis to contribute to the centrifugal force.

Embodiment 17: The method of any prior embodiment, wherein the tubular assembly is wrapped around the support structure and follows a helical path.

Embodiment 18: The method of any prior embodiment, wherein flowing the production fluid includes rotating the support structure about the longitudinal axis to contribute to the centrifugal force.

Embodiment 19: The method of any prior embodiment, wherein the tubular assembly follows a spiral path at a surface of the support structure.

Embodiment 20: The method of any prior embodiment, wherein the at least one inner tube includes a plurality of inner tubes having progressively smaller sizes and having respective inlets at successively greater distances from the outer tube inlet, the plurality of inner tubes including an intermediate inner tube having an intermediate inlet at a first distance from the outer tube inlet, and an innermost tube having an innermost inlet at a second distance from the outer tube inlet, the second distance being greater than the first distance, the intermediate tube configured to discharge fluid including the high density fluid into an annular region of the borehole and the innermost tube configured to discharge fluid including the low density fluid into the fluid conduit.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for separating fluids and controlling flow of production fluid, comprising:

a support structure configured to be disposed in a borehole in a resource bearing formation, the support structure including a fluid conduit; and a tubular assembly disposed at the support structure, the tubular assembly including:

an outer tube defining a flow path and having an outer tube inlet in fluid communication with the production fluid, the production fluid including an initial concentration of a low density fluid and an initial concentration of a high density fluid; and at least one inner tube disposed eccentrically within the outer tube and following the flow path;

wherein at least one of the support structure and the tubular assembly is configured to cause a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid, one or more of the at least one inner tube having an inner tube outlet in fluid communication with the fluid conduit.

2. The apparatus of claim 1, wherein the low density fluid is a hydrocarbon fluid and the high density fluid is water.

3. The apparatus of claim 1, wherein the outer tube has an outer tube, and the inner tube is configured to discharge the second fluid portion into a production conduit connected to a surface location.

4. The apparatus of claim 1, wherein the flow path is a circumferential path around a central axis, the central axis at least partially parallel to a longitudinal axis of at least one of the borehole and a borehole string, and flow of the production fluid along the fluid path causes at least part of the centrifugal force.

5. The apparatus of claim 4, wherein the outer tube defines an outer tube axis, the at least one inner tube defines an inner tube axis, the inner tube axis offset from the outer tube axis in a radial direction toward the central axis.

6. The apparatus of claim 4, wherein the support structure has an elongated shape corresponding to the circumferential path and is configured to rotate about the longitudinal axis to contribute to the centrifugal force.

7. The apparatus of claim 4, wherein the tubular assembly is wrapped around the support structure and follows a helical path.

8. The apparatus of claim 1, wherein the support structure is configured to rotate about a rotational axis, rotation of the support structure contributing to the centrifugal force.

9. The apparatus of claim 7, wherein the tubular assembly follows a spiral path at a surface of the support structure.

10. The apparatus of claim 1, wherein the at least one inner tube includes a plurality of inner tubes having progressively smaller sizes and having respective inlets at successively greater distances from the outer tube inlet, the plurality of inner tubes including an intermediate inner tube having an intermediate inlet at a first distance from the outer tube inlet, and an innermost tube having an innermost inlet at a second distance from the outer tube inlet, the second distance being greater than the first distance, the intermediate tube configured to discharge fluid including the high density fluid into an annular region of the borehole and the innermost tube configured to discharge fluid including the low density fluid into the fluid conduit.

11. The method of claim 1, wherein the flow path is a circumferential path around a central axis, the central axis at least partially parallel to a longitudinal axis of at least one of the borehole and a borehole string, and flow of the production fluid along the flow path causes at least part of the centrifugal force.

12. The method of claim 11, wherein the outer tube defines an outer tube axis, the at least one inner tube defines an inner tube axis, the inner tube axis offset from the outer tube axis in a radial direction toward the central axis.

13. The method of claim 11, wherein the support structure has an elongated shape corresponding to the circumferential path, and flowing the production fluid includes rotating the support structure about the longitudinal axis to contribute to the centrifugal force.

14. The method of claim 11, wherein the tubular assembly is wrapped around the support structure and follows a helical path.

15. A method of separating fluids and controlling flow of production fluid, comprising:

disposing a fluid production apparatus in a borehole in a resource bearing formation, the fluid production apparatus including a support structure having a fluid conduit and a tubular assembly disposed at the support structure, the tubular assembly including an outer tube defining a flow path and having an outer tube inlet in fluid communication with the production fluid, the fluid production apparatus including at least one inner tube disposed eccentrically within the outer tube and following the flow path;

receiving a production fluid via the outer tube inlet, the production fluid including fluid from the formation, the production fluid including an initial concentration of a low density fluid and an initial concentration of a high density fluid;

flowing the production fluid along the flow path, wherein flowing causes a centrifugal force on the production fluid that at least partially separates the production fluid into a first fluid portion having a higher concentration of the high density fluid than the initial concentration of the high density fluid, and a second fluid portion having a higher concentration of the low density fluid than the initial concentration of the low density fluid; and discharging the second fluid portion from an inner tube outlet into the fluid conduit and receiving the second fluid portion at a surface location.

16. The method of claim 15, wherein the low density fluid is a hydrocarbon fluid and the high density fluid is water.

17. The method of claim 15, further comprising discharging the second fluid portion into an annular region of the borehole.

18. The method of claim 11, wherein flowing the production fluid includes rotating the support structure about the longitudinal axis to contribute to the centrifugal force.

19. The method of claim 18, wherein the tubular assembly follows a spiral path at a surface of the support structure.

20. The method of claim 15, wherein the at least one inner tube includes a plurality of inner tubes having progressively smaller sizes and having respective inlets at successively greater distances from the outer tube inlet, the plurality of inner tubes including an intermediate inner tube having an intermediate inlet at a first distance from the outer tube inlet, and an innermost tube having an innermost inlet at a second distance from the outer tube inlet, the second distance being greater than the first distance, the intermediate tube configured to discharge fluid including the high density fluid into an annular region of the borehole and the innermost tube configured to discharge fluid including the low density fluid into the fluid conduit.

* * * * *